US007540554B2

(12) United States Patent
Bals

(10) Patent No.: US 7,540,554 B2
(45) Date of Patent: Jun. 2, 2009

(54) HINGE

(75) Inventor: Jochen Bals, Froendenberg (DE)

(73) Assignee: Edscha AG, Remscheid (DE)

( * ) Notice: Subject to any disclaimer, the term of this patent is extended or adjusted under 35 U.S.C. 154(b) by 477 days.

(21) Appl. No.: 10/542,868

(22) PCT Filed: Jan. 20, 2004

(86) PCT No.: PCT/DE2004/000076

§ 371 (c)(1),
(2), (4) Date: Jul. 20, 2005

(87) PCT Pub. No.: WO2004/065740

PCT Pub. Date: Aug. 5, 2004

(65) Prior Publication Data

US 2006/0082186 A1 Apr. 20, 2006

Related U.S. Application Data

(60) Provisional application No. 60/492,620, filed on Aug. 4, 2003.

(30) Foreign Application Priority Data

Jan. 22, 2003 (DE) ..... 103 02 553

(51) Int. Cl.
*B60J 5/10* (2006.01)

(52) U.S. Cl. ..... 296/146.4; 296/146.11

(58) Field of Classification Search ..... 16/50, 16/54, 366; 49/333, 334, 338, 339, 340; 296/56, 76, 146.4, 146.8, 146.11
See application file for complete search history.

(56) References Cited

U.S. PATENT DOCUMENTS

| | | | | |
|---|---|---|---|---|
| 876,166 | A * | 1/1908 | Gard | 49/334 |
| 1,637,575 | A * | 8/1927 | Kushland et al. | 49/338 |
| 2,363,667 | A * | 11/1944 | Griswold | 403/102 |
| 6,175,991 | B1 * | 1/2001 | Driesman et al. | 16/366 |

(Continued)

FOREIGN PATENT DOCUMENTS

| | | |
|---|---|---|
| DE | 197 44 908 | 4/1999 |

(Continued)

*Primary Examiner*—Glenn Dayoan
*Assistant Examiner*—Paul A Chenevert
(74) *Attorney, Agent, or Firm*—Davidson, Davidson & Kappel, LLC

(57) ABSTRACT

A hinge for a vehicle flap is provided which includes a first hinge part (2), mounted on one of the door arrangement elements flap and flap frame, a second hinge part (3), mounted on the other door arrangement element, a hinge pin (4) which is linked with the first hinge part (2) and the second hinge part (3) so as to be pivoted about a first pivoting axis (S), and a lever arrangement (17), coupling the first hinge part (2) with the second hinge part (3). The lever arrangement comprises at least on first lever (20), the lever (20) being linked with the hinge part (2) located on the flap so as to be pivoted. The hinge allows for a safe and controlled opening and closing of an automotive flap. For this purpose, a fixing device (24) for a motor (16) is provided on the hinge part (2) disposed on the flap and the first lever (20) of the lever arrangement (17) is rotationally driven by the motor (16).

27 Claims, 5 Drawing Sheets

U.S. PATENT DOCUMENTS

| | | | | |
|---|---|---|---|---|
| 6,457,207 | B1 * | 10/2002 | Horberg | 16/50 |
| 6,575,517 | B2 * | 6/2003 | Yamagishi et al. | 296/76 |
| 6,601,903 | B2 * | 8/2003 | Nakagome | 296/76 |
| 6,634,140 | B1 * | 10/2003 | Sellman | 49/340 |
| 6,789,834 | B2 | 9/2004 | Schlegel | 296/76 |
| 7,243,977 | B2 * | 7/2007 | McIntyre et al. | 296/146.8 |
| 2003/0102692 | A1 * | 6/2003 | Mooy et al. | 296/146.11 |
| 2004/0113456 | A1 * | 6/2004 | Greuel et al. | 296/146.8 |
| 2004/0244294 | A1 * | 12/2004 | Schachtl | 49/339 |
| 2005/0150078 | A1 * | 7/2005 | Bittner et al. | 16/221 |

FOREIGN PATENT DOCUMENTS

| | | | |
|---|---|---|---|
| DE | 198 54 211 | | 5/2000 |
| DE | 101 52 696 | | 4/2003 |
| EP | 1 004 736 | | 5/2000 |
| EP | 1 070 818 | | 1/2001 |
| JP | 06227256 | A * | 8/1994 |
| JP | 08085316 | A * | 4/1996 |
| WO | WO 01/81699 | | 11/2001 |

* cited by examiner

HINGE

FIELD OF THE INVENTION

The invention relates to a hinge for a vehicle flap comprising a first hinge part, which can be fastened to one of the door arrangement parts of the flap and flap frame, a second hinge part, which can be fastened to the other of the door arrangement parts.

BACKGROUND

DE 198 54 211A1 shows a hinge for a vehicle flap, in which a first hinge part is arranged on the tailgate and a second hinge part is arranged on a body part, the first hinge part and the second hinge part being connected to each other pivotably by means of a hinge pin. Provided on the first hinge part parallel to the hinge pin is a bearing sleeve, in which a locating bolt supporting a three-dimensionally coiled spiral spring is rotatably mounted. A first end section of the spiral spring bears with prestress against the hinge pin and a second end section is supported with prestress on a bearing pin arranged on the bearing sleeve. Furthermore, arranged on the locating bolt is a first lever which is coupled pivotably to a second lever arranged on the second hinge part. A disadvantage with this type of hinge is the fact that only a support of the opening movement of the vehicle flap is possible by the spiral spring. By contrast, during closing of the vehicle flap the spiral spring has to be prestressed again, as a result of which, during the closing movement, a force resulting from the bending force of the spring has to be overcome. Furthermore, the arrangement of the levers and locating bolts on both sides of the pivot mounting of the hinge parts is complicated in terms of installation and does not permit retrofitting. A possibility of arresting the flap in a partially open position is not envisaged.

DE 197 44 908 A describes a drive device for a front flap or tailgate of a motor vehicle, comprising a flap hinge, in which the pin of a hinged joint corresponds to the transmission output shaft of a drive motor which, like the hinged joint, is arranged in the region of a stop part on the body. A disadvantage of this device is, in particular, the space required by the motor in the region of the stop parts on the body, since said stop parts are generally arranged on the outside as far as possible and therefore do not permit the arrangement of a motor or permit it only under very unfavorable conditions, for example in the wing outside the trunk, with the shaft for this having to be guided through the body sheet and having to be sealed and there being hardly any protection against dirt and water.

WO 01 81 699 A1 describes a drivable flap hinge for an articulated connection of a flap, in which a first hinge part and a second hinge part are coupled pivotably to each other via a first link and a second link which are arranged in the manner of a four-bar hinge. A pin of a hinged joint of the first link to the hinge part arranged on the flap is designed as a drive shaft for a drive motor. The drive motor is arranged in a housing in the region of the first link, the drive motor being arranged with the housing on that side of the first link to the hinge part arranged on the body and being able to pivot past the second link.

SUMMARY OF THE INVENTION

In accordance with the present invention, a hinge for a vehicle flap is provided. The hinge includes first and second hinge parts, each being fastenable to one or the other of a vehicle flap and a vehicle flap frame. A hinge pin connects the first hinge part and the second hinge part to each other in a pivotably manner about a pivot axis. The hinge pin is accommodated in a rotationally fixed manner in one of the two hinge parts and is mounted pivotably in the other of the two hinge parts. A lever arrangement couples the first hinge part to the second hinge part, the lever arrangement includes at least one first lever, and the first lever is connected pivotably to the one of the first and second hinge parts that is fastenable to the vehicle flap. A motor is arranged on said one of the first and second hinge parts (i.e., the hinge part fastenable to the vehicle flap) by a mount. The first lever of the lever arrangement can be driven rotationally by the motor.

It is an object of the invention to provide a hinge which allows safe and controlled opening and closing of a vehicle flap. The object is achieved by providing a mount for a motor on the hinge part arranged on the flap, and by the fact that the first lever of the lever arrangement can be driven rotationally by the motor.

By means of the configuration according to the invention, of the first lever in which it can be driven rotationally by the motor, it is possible, by changing the direction of rotation of the motor, to assist both an opening movement and a closing movement of the vehicle flap. The motor makes it possible to stop the opening or closing movement of the vehicle flap in any desired open position and to release it again in any desired direction. As a result the vehicle flap is secured in any desired open position without manual intervention. In addition, it is possible for the movement of the vehicle flap to be converted at a desired point from an opening movement into a closing movement and vice versa.

In the case of the opening movement, this affords the advantage of the vehicle flap, in a first opening angle, experiencing an assisting force by the motor force, and, in a second opening angle which contains an end opening position, experiencing a retarding action, thus enabling the vehicle flap to be swung up slowly into the end opening position.

By retarding the vehicle flap counter to the closing direction during the closing movement, objects, for example, can be prevented from becoming jammed in between the vehicle flap and the flap frame. Furthermore, it avoids the vehicle flap striking against the flap frame. The precise position of the flap can be reliably detected independently of end stops and of the driven drive shaft of the motor by means of an appropriate sensor, for example, potentiometer fitted in one of the pivoting hinged joints, and may be made possible in accordance with a closed-loop control of the drive.

In addition, an assistance of the opening movement or closing movement during the entire pivoting movement of the vehicle flap is possible, so that a fully automatic opening and closing of the vehicle flap is achieved.

By means of the arrangement according to the invention of a holder for the motor on the hinge part arranged on the flap, the motor follows the flap during the opening and closing movement. As a result, one end of the vehicle flap can pivot during the opening movement into a water channel which becomes free because of the pivoting movement and is arranged on the flap frame. This achieves a visually attractive manner of accommodating the motor, in which the edge of the flap at the same time remains free from the holder and the corresponding unsightly thickened area.

A further advantage is that, by means of the arrangement according to the invention of the holder on the hinge part, the motor itself can be attached by means of a simple mounting process. The effect also achieved by this is that a retrofitting of the hinge with a motor is possible, and a replacement of a motor which, for example, is defective is realized in a simple manner. It is preferably possible for at least all of the movable parts of the lever arrangement to be placed onto the two hinge parts from one side, so that the dismantled hinge can be pivoted about the pivot axis without a servo drive, and the lever arrangement is used with the motor, the lever arrangement applying the force for opening and closing the two hinge parts, and the pivot axis being subject only to a small amount of load, and, in particular, no moments being produced transversely with respect to the hinge axis.

In one preferred refinement, the two hinge parts define an inner angle region which defines the opening angle of the flap and in which the lever arrangement and the motor are expediently arranged. As a result, the construction space of the hinge is advantageously reduced, so that a space-saving attachment of the hinge to the flap frame is made possible, with both the lever arrangement and the motor being covered to the outside by the two hinge parts, so that these components are perceived by a user in a visually non-disturbing manner.

The lever arrangement preferably comprises a second lever which is expediently connected pivotably to the first lever in an auxiliary pivot axis, the first lever preferably having an H-shaped configuration and being coupled with a first pair of limbs to the second lever. With a second pair of limbs, the first lever is coupled to a web arranged on the flap hinge part. The second lever is advantageously arranged on the other hinge part by means of a shank. As a result, an advantageous supporting of the first lever on the second lever and on the shank arranged thereon is achieved during an opening movement of the hinge, thus resulting in an action of the lever arrangement which assists the opening and closing movement of the hinge.

The lever arrangement expediently defines a step-up from the motor to the second hinge part, so that an effort which a user needs to make for opening and closing the flap is advantageously reduced. The effect also achieved by this is that the force which is to be applied by the motor for the closing and opening is also reduced, and a lower-powered motor can be used, as a result of which, for example, in the case of an electric motor, there is a lower power consumption and more compact constructional form.

A drive axis which is defined by the drive shaft of the motor is preferably oriented parallel to the pivot axis of the two hinge parts, the drive axis extending in an axially offset manner with respect to the hinge pin and not engaging in a region of the two hinge parts. In addition, the lever arrangement is preferably arranged between the two hinge parts and the holder for the motor, thus achieving an advantageous separation of the two hinge parts from the lever arrangement and the motor. As a result, simple installation of the hinge is possible, with the two hinge parts first of all being connected to each other and then the lever arrangement and the motor being installed. Furthermore, a retrofitting of the hinge with the lever arrangement and the motor is made possible, and a simple retrofitting or conversion of the motor for the hinge is achieved.

A clutch is expediently provided in the motor, for example a sliding clutch, which advantageously makes it possible to set the motor to idle, so that the flap movement is free from the actuation of the motor, with the result that the motor assistance can be extended, for example, during the closing process, in a certain region in which the weight of the flaps sufficiently assists the closing movement. It can thus furthermore be achieved that, for example, if a motor is defective, the flap cannot be actuated manually by the user counter to the retaining forces produced by the defective motor.

BRIEF DESCRIPTION OF THE DRAWINGS

The invention is explained in more detail below using a preferred exemplary embodiment of a hinge according to the invention with reference to the attached drawings.

DETAILED DESCRIPTION

Figure 1:
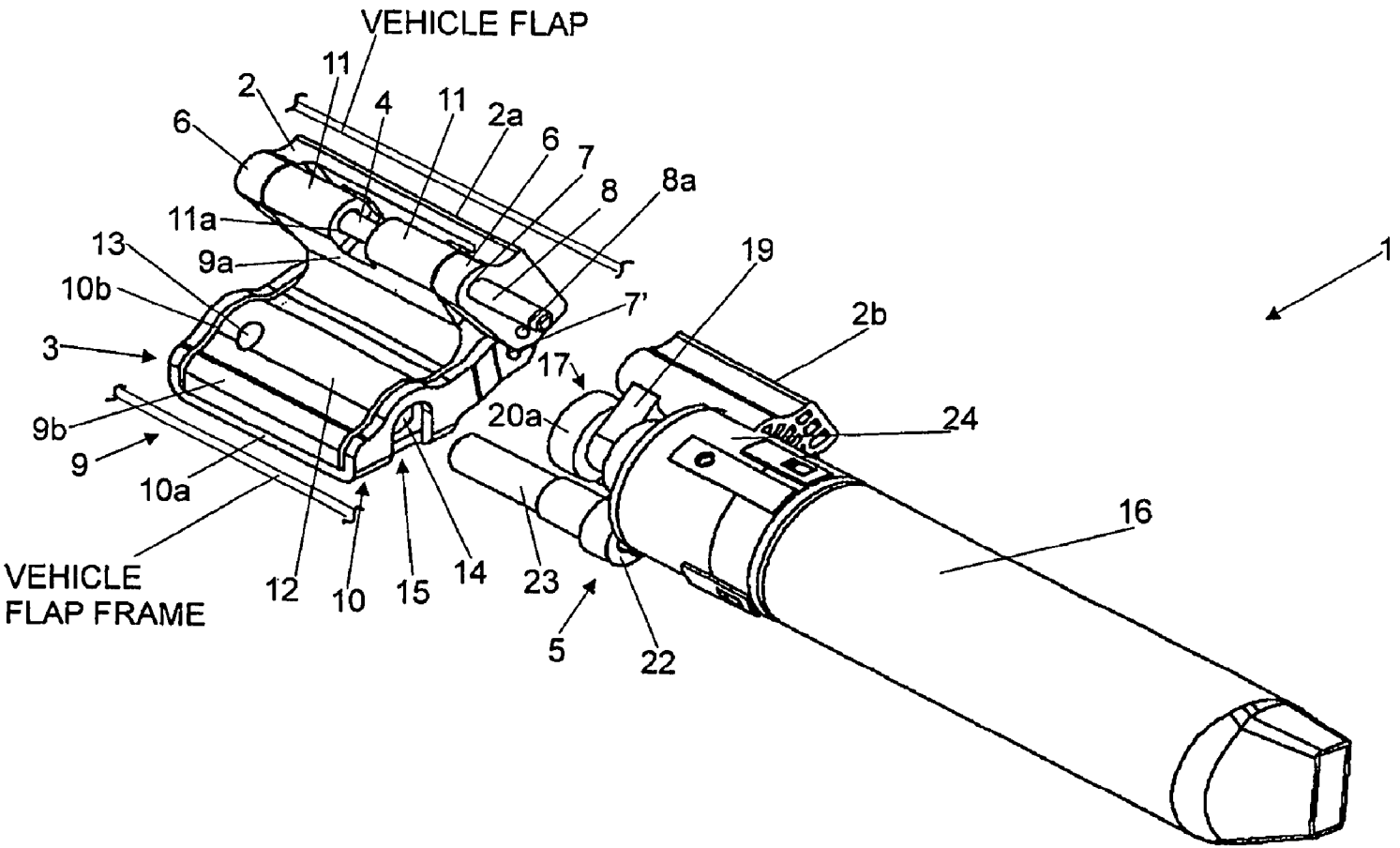
FIG. 1 shows a perspective view of a first preferred exemplary embodiment of a hinge according to the invention.
Figure 2:
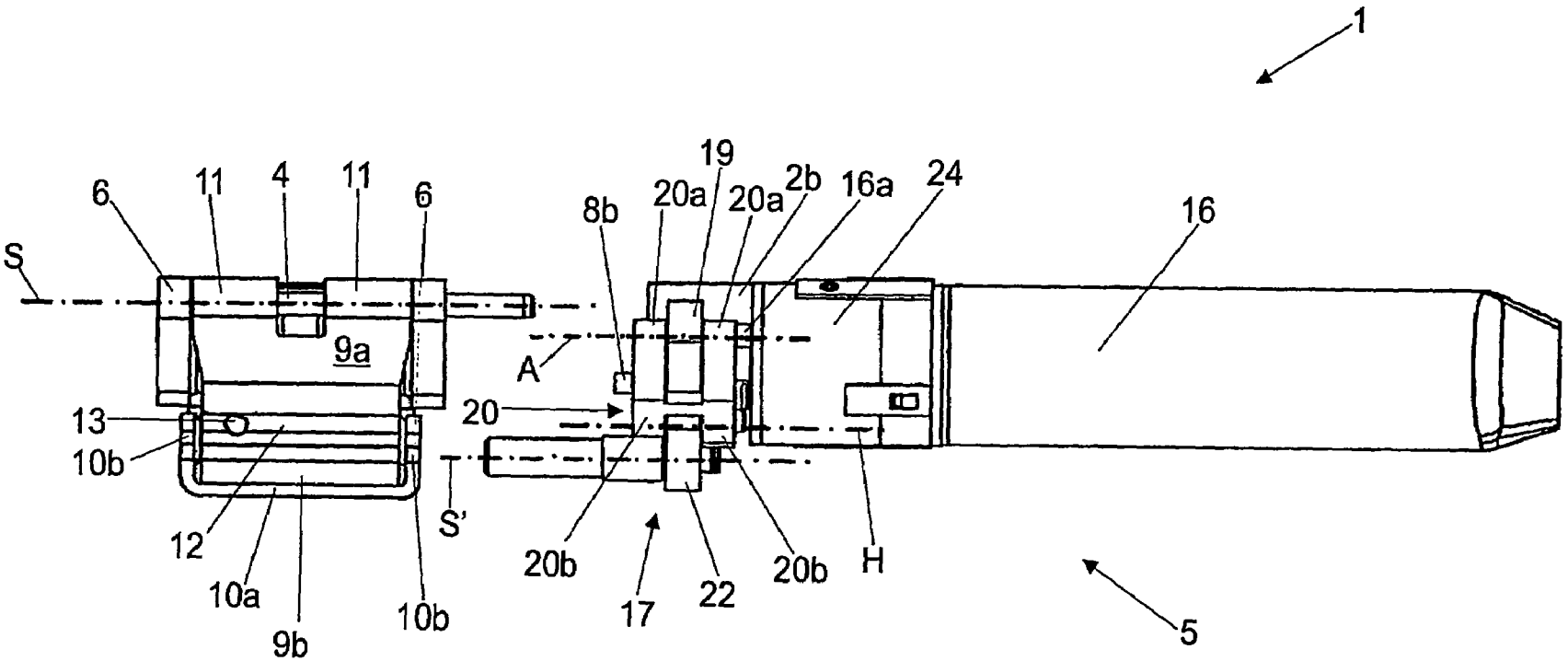
FIG. 2 shows a side view of the hinge from FIG. 1.
Figure 3:
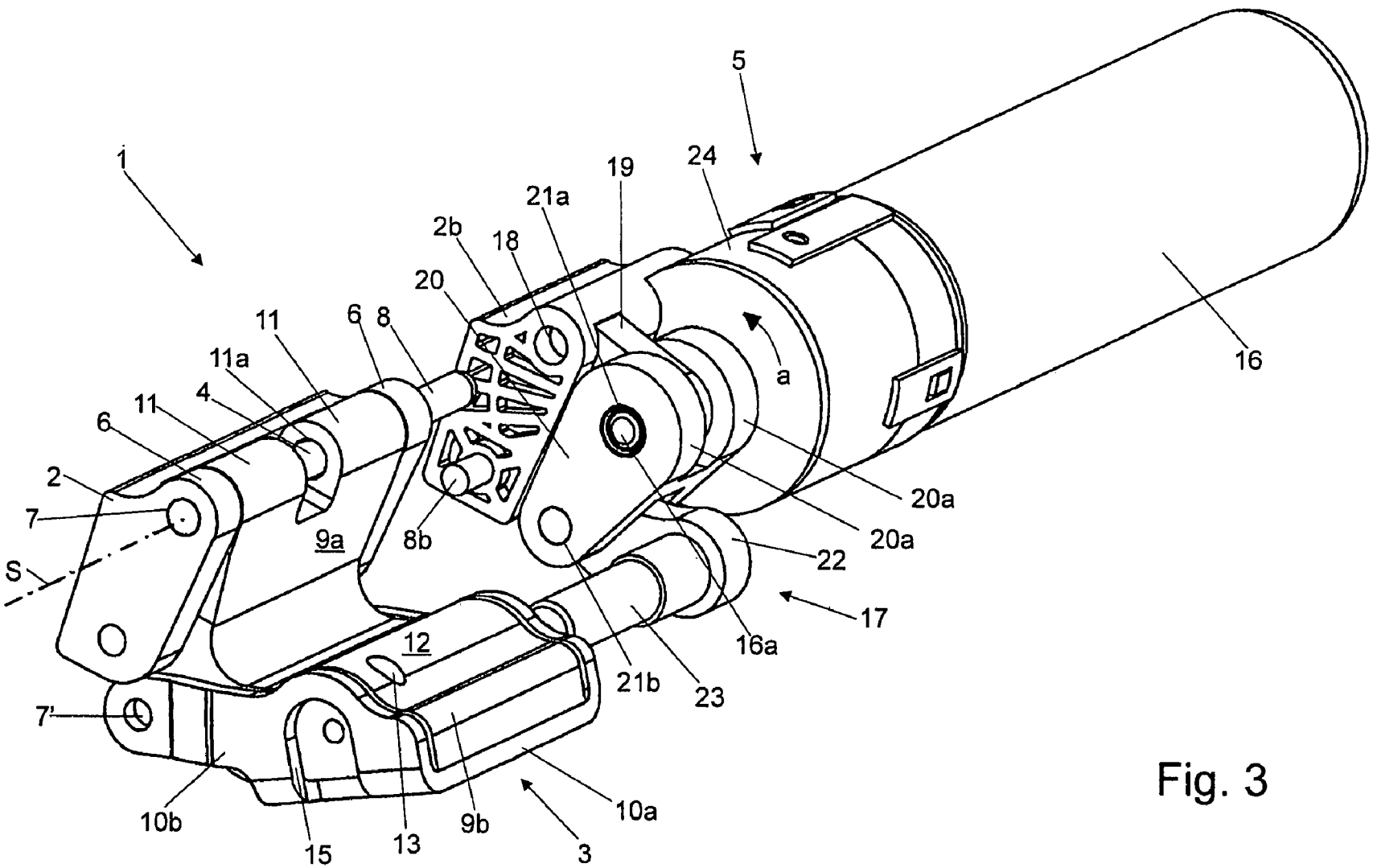
FIG. 3 shows a further perspective view of the hinge from FIGS. 1 and 2.

FIGS. 1 to 3 show a first exemplary embodiment of a hinge 1 according to the invention, in which a first hinge part 2 is connected to a second hinge part 3 pivotably about a pivot axis S by means of a hinge pin 4. The present flap is designed as a tailgate of a passenger vehicle and is fastened by two hinges of this type to the corresponding frame of a motor vehicle.

The first hinge part 2 is designed as a sheet-metal shaped part and comprises a planar plate 2*a* which forms a bearing surface for the vehicle flap and on which two projecting extensions 6 are arranged as bent-off surface sections, in which one gudgeon 7 is provided in each case. The plate 2*a* is provided with two apertures which permit a fastening to the vehicle flap, for example, by means of screws.

The hinge pin 4 is mounted rotatably in the gudgeons 7. The hinge pin 4 has a continuation 8 which is continued over one of the two extensions 6 in the direction of a drive unit 5, which is explained in more detail below. It can be seen that the extension 6 is oriented essentially perpendicularly to the plate 2*a* and extends along the plate 2*a*, the extension facing the drive unit 5 having a hollow, which runs parallel to the hinge axis S and is in the form of a cylindrical holder 8*a*.

The second hinge part 3 comprises an inner segment 9 and an outer segment 10 which are designed as two parts which can be released from each other. It is possible also to design the second hinge part 3 as a single piece.

The inner segment 9 is of V-shaped design with an angle of approximately 80° in the manner of an elbow in the form of an extruded part. A first limb 9*a* of the inner segment 9, which limb protrudes from the outer segment 10, has, in an end facing away from the angle of the V, two sections 11 which are separated by a punched-free portion and are both passed through by a coaxial longitudinal bore 11*a*, in which the hinge pin 4 is arranged in a rotationally fixed manner. The first limb 9*a*, and, in particular, the outer surface thereof which faces the first hinge part, is oriented essentially parallel to the plate 2*a* of the first hinge part in a closed position of the hinge 1. In an open position of the hinge 1, the first limb 9*a* and the first hinge part 2 are at a maximum angle of between 80° and 120° from each other, which angle corresponds to the opening angle of the flap.

A second limb 9*b* of the V-shaped, inner segment 9, which limb is in contact with the outer segment 10, has, in a central region of its surface facing the first limb 9*a*, a curvature 12, which runs parallel to the hinge axis and in which is formed a fastening bore 13 with which the inner segment 9 can be fixed on the outer segment 10 of the second hinge part 3, for example, by means of a screw. The curvature 12 surrounds a holder 14 in the second limb 9*b*, said holder having an inlet opening in the narrow side of the second limb 9*b*.

The outer segment 10 is designed as a sheet-metal shaped part in which the inner segment 9 is arranged in a bearing manner, the outer segment 10 comprising a base 10*a* and two side walls 10*b*. The base 10*a* of the outer segment 10 bears against an outwardly directed surface of the second limb 9*b* of the inner segment 9, with the second limb 9*b* resting on the base 10*a* in a region making up approximately half of the second limb 9*b* protruding from the angle of the V. Three fastening bores for fastening to the flap frame are provided in the base 10*a*.

The side walls 10*b*of the outer segment 10 engage around the end sides of the second limb 9*b* of the inner segment 9 along the entire extent thereof and end flush with the angle region of the V. In the region of the inlet opening of the holder 14 of the inner segment 9, apertures 15 are provided in the side walls 10*b*.

In their ends assigned to the angle of the V, the two side edges 10*b* each have an auxiliary gudgeon 7' through which a pivoting and articulated connection of the outer segment 10 to the inner segment 9 is provided. If the connection of the two segments is stopped at 13, the inner segment 9 can be pivoted with the first hinge part 2 in relation to the outer segment 10 and the frame of the vehicle into a painting position, with the flap being pivoted at the same time into an open position, so that that region of the frame of the vehicle to which it is otherwise difficult to gain access, can be painted. It goes without saying that the drive unit 5 is inserted only after the flap has been painted.

The drive unit 5, which forms a separate structural unit, comprises a lever arrangement 17 and a motor 16 and can be connected axially, with respect to the hinge axis S, to the two hinge parts 2, 3, the drive unit 5 coupling the two hinge parts 2, 3 by means of the lever arrangement 17 outside the hinge axis S and carrying out a pivoting, which corresponds to the pivoting movement about the axis S, in such a manner that also just one position of the lever arrangement 17 corresponds to each pivoting angle of the flap.

The drive unit 5 can be connected to the two hinge parts 2, 3 by a simple plug-in installation, thus advantageously permitting retrofitting or replacement with little outlay on installation.

The drive unit 5 comprises a bearing plate 2*b* which is produced from plastic by injection molding and has an outer surface which is designed for bearing against the flap and is aligned with the plate 2*a*. The bearing plate 2*b* is exclusively connected to the end side of one extension 6 so that the bearing plate 2*b* forms a unit together with the first hinge part 2. For the rotationally fixing of the bearing plate 2*b* to the first hinge part 2, a bore 18 provided in the end side of the bearing plate 2*b* accommodates the continuation 8 of the hinge pin 4 while a shank-shaped projection 8*b* penetrates the holder 8*a* and thus at the same time produces a form-fitting, and in particular, rotationally fixed, connection. It is possible also to produce the connection by screws or welding or by any other known connecting means. The bearing plate is additionally stabilized by stiffening ribs and at the same time is lightweight. In order to enable a rotational movement of the hinge pin 4 in the bore 18, the latter is lined by a bearing bush.

It is possible to mount the hinge pin 4 rotatably in the longitudinal bores 11*a* and to fix it non-rotatably for this purpose in the gudgeons 7. In this case, there is also no relative rotation of the hinge pin 4 with respect to the bore 18, and the bearing bush can be omitted, and, if appropriate, an even better form-fitting connection is obtained by a non-circular design of the continuation 8.

The lever arrangement 17 comprises a web 19 which protrudes from the bearing plate 2*b* and extends perpendicular to the plate 2*b* in the direction facing away from the bearing surface for the flap. The web 19 is formed by a metal tab which is formed in the bearing plate 2*b* by encapsulation by means of injection molding and, if appropriate, is also passed through by the bore 18. At one end, which faces away from the bearing plate 2*b*, the web 19 has a pivoting hinged joint in which a first lever 20 of the lever arrangement 17 is mounted pivotably.

The first lever 20 is of H-shaped design, a first pair of limbs 20*a* forming the coupling to the web 19 in such a manner that the two first limbs 20*a* engage around the web 19 from both sides. Arranged in the two first limbs 20*a* are bores 21*a* in which a bolt is arranged in a rotationally fixed manner and, with the web 19, forms a rotatable mounting.

The first lever 20 comprises a second pair of limbs 20*b* which face away from the first pair of limbs 20*a* and form an articulated connection with a second lever 22 of the lever arrangement 17. The coupling to the second lever 22 is designed in such a manner that the two second limbs 20*b* engage around the lever 22 from two flat sides. Arranged in the two second limbs 20*b* are further bores 21*b* in which a further bolt is rotatably mounted, the further bolt being connected to the second lever 22 in a rotationally fixed manner. As an alternative, the further bolt can be provided in a rotationally fixed manner in the bores 21*b* and can be mounted rotatably on the second lever 22.

The coupling formed by the second pair of limbs 20*b* of the first lever 20 and by the second lever 22 defines an auxiliary pivot axis H which is oriented parallel to the pivot axis S.

The second lever 22 is of kidney-shaped design, with, at an end facing away from the coupling to the first lever 20, a bore being arranged in which a shank 23 of the lever arrangement 17 is rotatably mounted. The shank 23 is guided through the aperture 15 of the outer segment 10 and is arranged non-rotatably in the holder 14 arranged in the curvature 12 of the inner segment 9. The shank 23 defines a shank axis S' which is parallel to the pivot axis S.

An aperture 15 is advantageously formed in each of the two side edges 10*b*, since the lever arrangement 17 can therefore also be arranged on the other side of the two hinge parts 2, 3 using the structurally identical, second hinge part 3.

The lever arrangement 17 is arranged outside the hinge pin 4 or the pivot axis S and, depending on the selection of the length of the individual levers, defines a step-up from the motor 16 to the second hinge part 3. The auxiliary pivot axis H, which is defined by the coupling of the first lever 20 to the second lever 22, is moved at the same time during the closing and opening movement of the hinge 1.

A mount 24 for the motor 16 is provided on the bearing plate 2*b* on the side facing away from the bearing surface, the lever arrangement 17 being provided between the mount 24 or the motor 16 and the two hinge parts 2, 3. The mount 24 is formed as a single piece with the bearing plate 2*b* and comprises a cylindrical hollow body in which the motor 16 is provided. The motor 16, which is designed as an electric motor, can be accommodated and fixed in the mount 24, with a drive shaft 16*a*, which is driven by the motor 16 and protrudes in the direction of the lever arrangement 17, being aligned with the axis of the pivoting hinged joint between the web 19 and the first lever 20 and defining a drive axis A.

The drive shaft 16*a* of the motor 16 at the same time forms the bolt of the coupling of the first pair of limbs 20*a* of the first lever 20 to the web 19, as a result of which the drive shaft 16*a* of the motor 16 is connected in a rotationally fixed manner to the first pair of limbs 20*a* and a rotation of the drive shaft 16*a* is transmitted to the first lever 20. It is possible, in order to facilitate a separate replacement of the motor 16, to insert the drive shaft 16*a* in a form-fitting manner into a hinged-joint pin or into a limb 20*a*, with it being possible, after the motor 16 has been released from the mount 24, for it to be pulled away axially.

The motor 16 is connected to the vehicle control system, the latter driving the flap in the closing or in the opening direction through specification of the direction of rotation of the motor 16. Furthermore, an idling position is provided in which the drive shaft 16*a* is connected freely and the flap can be actuated manually. Finally, the drive shaft 16*a* is connected to the motor via a sliding clutch, so that in the event of overload or if the control system fails, a manual actuation of the flap is possible. Furthermore, end stops for the flap movement are connected to the control system. As an alternative, it is possible to arrange in the hinge mounting a potentiometer which supplies actual values for the pivoting angle over the entire angle region to the control system, and thus enables a very precise acceleration or braking of the motor 16 by closed-loop control. The connection of a rotation-resistance measuring device of this type to the continuation 8, which penetrates the bearing plate 2*a*, is particularly favorable, because the electric cabling has to be provided only in the event of retrofitting, and the connection to the control system can take place in common with the connection of the motor 16.

The lever arrangement 17 gives rise to three axes, the drive axis A, which is defined by the drive shaft 16*a* of the motor 16, the auxiliary pivot axis H, which is defined by the coupling of the first lever 20 to the second lever 22, and the shank axis S', which is defined by the shank 23, which axes are all oriented parallel to one another and parallel to the pivot axis S, but are situated outside the pivot axis S.

Although the drive axis A and the pivot axis S are parallel to each other, they are not situated next to each other. The drive axis A of the drive shaft 16*a* of the motor 16 engages on the first pair of limbs 20*a* of the first lever 20, which is arranged outside the two hinge parts 2, 3, and does not extend beyond the lever 20. The auxiliary pivot axis H is arranged in the same direction, not next to the pivot axis S.

Figure 4:
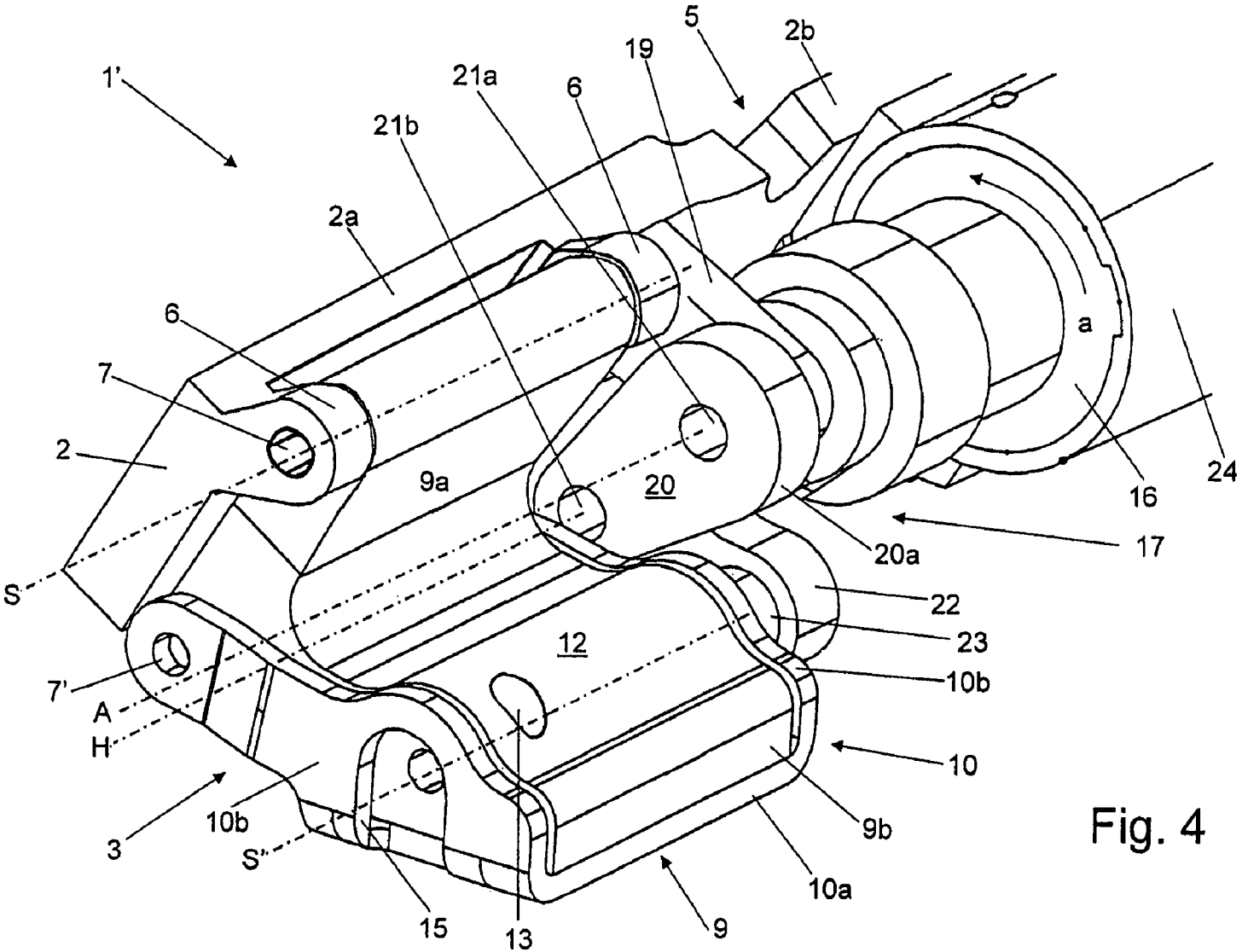
FIG. 4 shows a perspective view of a second preferred exemplary embodiment of a hinge according to the invention.
Figure 5:
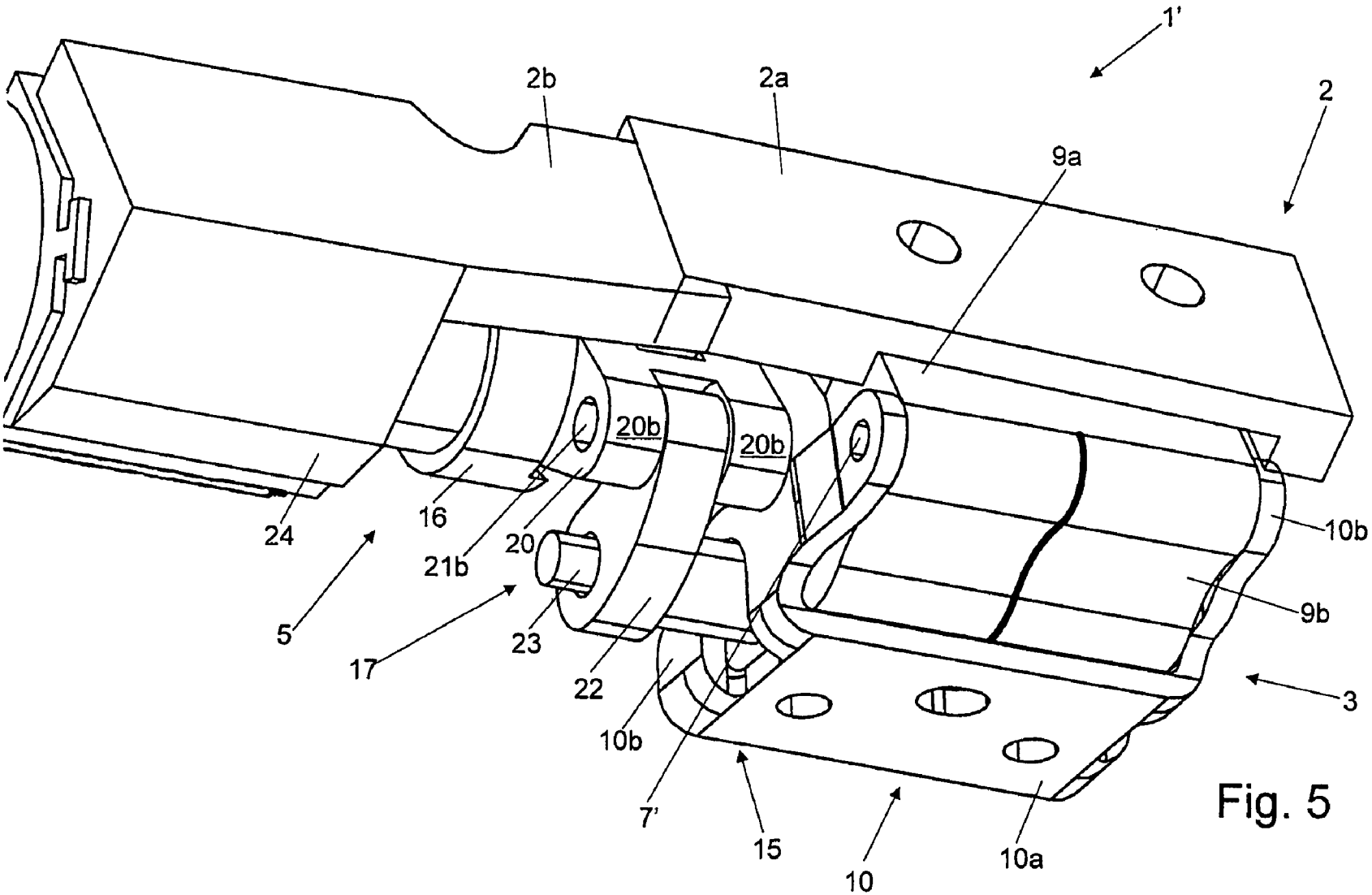
FIG. 5 shows a further perspective view of the hinge from FIG. 4.

FIGS. 4 and 5 describe a second preferred exemplary embodiment, with the same reference numbers as in FIGS. 1 to 3 referring to the same or structurally comparable parts, so that essentially the differences are discussed below.

In contrast to FIGS. 1 to 3, the plate 2*a* is continued in the direction of the drive unit, so that a single-piece fastening surface for the flap is formed. As a metallic part, the web 19 is fastened to the plate 2*a* by welding, and remains on the first hinge part 2 even if the lever arrangement 17 is otherwise disassembled. A continuation of the hinge pin 4 is not required. The mount 24 of the motor 16 is placed and secured on the continued region 2*b* of the plate 2*a*.

The hinge functions as follows:

To open the hinge 1, the motor 16 is actuated and the drive shaft 16*a* is caused to rotate along the arrow direction a. By means of the rotation of the drive shaft 16*a*, a force engaging on the first pair of limbs 20*a* is transmitted to the first lever 20, as a result of which the first pair of limbs 20*a* of the first lever 10 is pressed in the direction of the first hinge part 2. At the same time, the second pair of limbs 20*b* experiences a force acting in the opposite direction, as a result of which the first lever 20 is supported on the second lever 22 and assists the pivoting of the first lever 20. By means of the pivoting of the first lever 20, a force acting in the direction of the first hinge part 2 is transmitted to the web 19, as a result of which the web 19 is pivoted in relation to the first lever 20 in its common coupling, the driver axis A, and the first hinge part 2 is pivoted about the pivot axis S, and the web 19 presses against the plate 2*b*, and the first hinge part 2, which is connected by means of the continuation 8 of the hinge pin 4, is pivoted about the pivot axis S in relation to the second hinge part 3 in the opening direction.

During the pivoting movement of the hinge 1, the auxiliary pivot axis H and the drive axis A are subject to a movement, the orientation of which, however, remains parallel to the pivot axis S and the shank axis S' during the entire opening movement.

By means of the step-up provided by the lever arrangement 17, the pivoting of the web 19 in relation to the first lever 20 and therefore the opening movement of the hinge 1 are assisted.

To close the hinge 1, the motor 16 is set into a rotation opposed to the arrow direction a and the first lever 20 experiences a lever action, in which the first pair of limbs 20*a* experiences an action which is directed away from the first hinge part 2 along the web 19, as a result of which the first lever 20 pulls on the web 19 and the first hinge part 2 is pivoted about the pivot axis S and the hinge 1 is therefore closed.

The invention has been described above with reference to two exemplary embodiments. It has to be understood that individual configurations of the one exemplary embodiment can readily be transferred to the other exemplary embodiment without all of the features having to be changed.

The invention has been described above with reference to exemplary embodiments which relate to a tailgate of a motor vehicle. It has to be understood that the invention can likewise be used for any other type of flap, i.e. a part coupled movably to a vehicle, in particular front hoods and trunk lids, parts which can be hooked out, such as sliding roofs and spoilers, or else roll bars, side vehicle doors, sliding doors, wing doors and the like.

What is claimed is:

1. A hinge for a vehicle flap, comprising:

a first hinge part, the first hinge part being fastenable to one door arrangement part, the one door arrangement part being one of a vehicle flap and a vehicle flap frame, a second hinge part, the second hinge part being fastenable to another door arrangement part, said another door arrangement part being the other of the vehicle flap and the vehicle flap frame;

a hinge pin connecting the first hinge part and the second hinge part to each other in a pivotably manner about a pivot axis, the hinge pin being accommodated in a rotationally fixed manner in one of the two hinge parts and being mounted pivotably in the other of the two hinge parts, a lever arrangement coupling the first hinge part to the second hinge part, the lever arrangement comprising at least one first lever, the first lever being connected pivotably to a one of the first and second hinge parts being fastenable to the vehicle flap, and a motor being arranged on said one of the first and second hinge parts by a mount, wherein the first lever of the lever arrangement can be driven rotationally by the motor, and wherein the lever arrangement couples the first hinge part to the second hinge part outside the hinge pin.

2. The hinge as claimed in claim 1, wherein the lever arrangement and the motor are arranged in an angle region being defined by the two hinge parts and wherein the angle region is to the inside with respect to the vehicle flap.

3. The hinge as claimed in claim 1, wherein the lever arrangement comprises at least three axes being arranged outside the pivot axis.

4. The hinge as claimed in claim 1, wherein the lever arrangement defines a step-up from the motor to the second hinge part.

5. The hinge as claimed in claim 1, wherein the lever arrangement is arranged between the two hinge parts and the holder for the motor.

6. The hinge as claimed in claim 1, wherein the motor has, for opening the two hinge parts, a direction of action directed counter to the hinge-opening direction.

7. The hinge as claimed in claim 1, wherein the second hinge part is a V-shaped hinge part, and in that the hinge pin is provided at one end of a limb of the V of the V-shaped hinge part.

8. The hinge as claimed in claim 1, wherein the motor is assigned a clutch which defines an idling of the motor.

9. The hinge as claimed in claim 1, wherein the motor is provided on a drive axis which is parallel to the pivot axis.

10. The hinge as claimed in claim 9, wherein the drive axis is provided outside the pivot axis.

11. The hinge as claimed in claim 1, wherein the lever arrangement comprises a second lever, and wherein the lever arrangement defines at least one auxiliary pivot axis which is arranged parallel to the pivot axis.

12. The hinge as claimed in claim 11, wherein the first lever and the second lever are connected to each other pivotably in the auxiliary pivot axis.

13. The hinge as claimed in claim 11, wherein the first lever is an H-shaped lever, and in that the second lever is a kidney-shaped lever.

14. The hinge as claimed in claim 11, further comprising a shank, the shank being parallel to the pivot axis, the shank being provided on the second hinge part and in that the second lever of the lever arrangement is coupled to the shank.

15. The hinge as claimed in claim 14, wherein the second lever is connected rotatably to the shank.

16. The hinge as claimed in claim 14, wherein the second lever is connected in a rotationally fixed manner to the shank.

17. The hinge as claimed in claim 11, wherein the first hinge part has a web, and wherein the first lever of the lever arrangement is coupled to the web.

18. The hinge as claimed in claim 17, wherein the first hinge part has a fastening surface being fastenable to the flap, and wherein the web protrudes perpendicularly with respect to the fastening surface.

19. The hinge as claimed in claim 17, wherein the motor further includes a drive shaft, and wherein the first lever can be driven rotationally by the drive shaft.

20. The hinge as claimed in claim 19, wherein the driving of the first lever by the drive shaft and the coupling of the first lever to the web take place along a common drive axis.

21. The hinge as claimed in claim 19, wherein the driving of the first lever by the drive shaft and the coupling of the first lever to the second lever take place in a common axis.

22. A hinge for a vehicle flap, comprising:

a first hinge part, the first hinge part being fastenable to one door arrangement part, the one door arrangement part being one of a vehicle flap and a vehicle flap frame, a second hinge part, the second hinge part being fastenable to another door arrangement part, said another door arrangement part being the other of the vehicle flap and the vehicle flap frame;

a hinge pin connecting the first hinge part and the second hinge part to each other in a pivotably manner about a pivot axis, the hinge pin being accommodated in a rotationally fixed manner in one of the two hinge parts and being mounted pivotably in the other of the two hinge parts, a lever arrangement coupling the first hinge part to the second hinge part, the lever arrangement comprising at least one first lever and one second lever, the first lever being connected pivotably to the one of the first and second hinge parts being fastenable to the vehicle flap, and the second lever being pivotably received on the other of the first and second hinge part being fastenable to the vehicle flap frame, a motor being arranged on said one of the first and second hinge parts by a mount, wherein the first lever of the lever arrangement can be driven rotationally by the motor.

23. A hinge for a vehicle flap, comprising:

a first hinge part, the first hinge part being fastenable to a vehicle flap, a second hinge part, the second hinge part being fastenable to a vehicle flap frame, and a hinge pin connecting the first hinge part and the second hinge part to each other in a pivotable manner about a pivot axis, the hinge pin being accommodated in a rotationally fixed manner in one of the two hinge parts and being mounted pivotably in the other of the two hinge parts, the first hinge part and the second hinge part each comprising at least one axial bearing arrangement for receiving a drive unit portion outside the pivot axis and having a main axis substantially parallel to the pivot axis.

24. A hinge for a vehicle flap, comprising:

a first hinge part, the first hinge part being fastenable to a vehicle flap, a second hinge part, the second hinge part being fastenable to a vehicle flap frame;

a hinge pin connecting the first hinge part and the second hinge part to each other in a pivotably manner about a pivot axis, the hinge pin being accommodated in a rotationally fixed manner in one of the two hinge parts and being mounted pivotably in the other of the two hinge parts, wherein a web protrudes from the first hinge part; and a lever arrangement coupling the first hinge part to the second hinge part, the lever arrangement comprising at least one first lever and one second lever, the first lever being connected pivotably to the web of the first hinge part about a first axis, and the second lever being connected pivotably to the second hinge part about a second axis, wherein the first lever is connected pivotably to the second lever about a third axis.

25. The hinge as claimed in claim 24, wherein each of the first axis, the second axis and the third axis is arranged outside the pivot axis.

26. The hinge as claimed in claim 24, wherein the motor is provided on a drive axis which is parallel to the pivot axis.

27. The hinge as claimed in claim 26, wherein the drive axis is provided outside the pivot axis.

* * * * *